US008461951B2

(12) United States Patent
Gassmann et al.

(10) Patent No.: US 8,461,951 B2
(45) Date of Patent: Jun. 11, 2013

(54) BISTABLE MAGNETIC ACTUATORS

(75) Inventors: Jörg Gassmann, Dresden (DE); Steffen Schnitter, Dresden (DE); Marcus Herrmann, Dresden (DE)

(73) Assignee: Johnson Electric Dresden GmbH, Dresden (DE)

( * ) Notice: Subject to any disclaimer, the term of this patent is extended or adjusted under 35 U.S.C. 154(b) by 0 days.

(21) Appl. No.: 13/639,730

(22) PCT Filed: Apr. 6, 2011

(86) PCT No.: PCT/DE2011/000371
§ 371 (c)(1),
(2), (4) Date: Dec. 4, 2012

(87) PCT Pub. No.: WO2011/131167
PCT Pub. Date: Oct. 27, 2011

(65) Prior Publication Data

US 2013/0076462 A1 Mar. 28, 2013

(30) Foreign Application Priority Data

Apr. 21, 2010 (DE) ..... 10 2010 017 874

(51) Int. Cl.
*H01F 7/08* (2006.01)

(52) U.S. Cl.
USPC ..... 335/276; 335/78; 335/79; 335/234

(58) Field of Classification Search
USPC ..... 335/78–86, 229–235, 266, 268, 269, 335/276
See application file for complete search history.

(56) References Cited

U.S. PATENT DOCUMENTS 2,759,114 A * 8/1956 Klett et al. ..... 310/29
3,315,104 A * 4/1967 Barr ..... 310/29

(Continued)

FOREIGN PATENT DOCUMENTS

DE 1938723 U 5/1966
DE 6751327 U 1/1969

(Continued)

OTHER PUBLICATIONS

Yohji Okada, et al., Electromagnetic Valve Actuator for Automobile Engines, Mar. 8, 2004, SAE International Techinical Paper No. 2004-01-1387.*

(Continued)

*Primary Examiner* — Ramon Barrera
(74) *Attorney, Agent, or Firm* — Norris McLaughlin & Marcus, P.A.

(57) ABSTRACT

In a bistable magnetic actuator with a polarized magnetic circuit with parallel operating air gaps, wherein between the outer legs of a U-shaped soft-iron yoke a flat permanent magnet is integrated that carries a soft-iron center leg and applies a permanent-magnetically created magnetic flux to a rocking armature supported on the center leg, wherein at each outer leg a separately controllable excitation winding provides swiveling pulses for the rocking armature to swivel from one permanent-magnetically self-holding swivel position into the other, the permanent-magnetically created magnetic flux through the magnetic circuit closed over the rocking armature in each case for an electromagnetic magnetic flux created by the excitation winding of said magnetic circuit in a direction opposed to the permanent-magnetically created magnetic flux commutates into the other parallel magnetic circuit with the electromagnetically not excited excitation winding, swiveling over the rocking armature.

7 Claims, 4 Drawing Sheets

U.S. PATENT DOCUMENTS

| | | | |
|---|---|---|---|
| 4,912,438 | A | 3/1990 | Yokoo |
| 5,805,039 | A | 9/1998 | Smith |
| 5,940,955 | A | 8/1999 | Smith |
| 6,107,903 | A | 8/2000 | Sako et al. |

FOREIGN PATENT DOCUMENTS

| | | | |
|---|---|---|---|
| DE | 3323481 | A1 | 1/1985 |
| DE | 4314715 | A1 | 11/1994 |
| DE | 69603026 | T2 | 11/1999 |
| DE | 202004012292 | U1 | 1/2005 |
| EP | 0197391 | A2 | 10/1986 |
| EP | 0313385 | A2 | 4/1989 |
| EP | 0863529 | A1 | 9/1998 |
| JP | 61150110 | A | 8/1986 |
| WO | 9706545 | A1 | 2/1997 |

OTHER PUBLICATIONS

International Search Report for PCT Application No. PCT/DE2011/000371 mailed Nov. 10, 2011.

* cited by examiner

BISTABLE MAGNETIC ACTUATORS

This is an application filed under 35 §371 of PCT/DE2011/000371, claiming priority to DE 10 2010 017 874.8 filed on Apr. 21, 2010.

BACKGROUND OF THE INVENTION

The invention relates to a bistable magnetic actuator provided with a polarized parallel circuit, wherein between the outer legs of a U-shaped soft-iron yoke a flat permanent magnet is integrated carrying a soft-iron centre leg and applies a permanent-magnetically created magnetic flux to a rocking armature supported on the centre leg, wherein at each outer leg a separately controllable excitation winding provides swiveling pulses for the rocking armature to swivel from one permanent-magnetically self-locking swivel position into the other. In prior art, a similar generic magnetic actuator is described in the utility model specification DE 20 2004 012 292 U1.

In deenergized state bistable, bipolar magnetic actuators can take two stable swivel positions. Frequently, said actuators comprise a parallel connection of two magnetic circuits made of soft-iron components to guide a magnetic flux, one or several electromagnetic excitation windings and at least one permanent magnet that over one or several air gaps generates forces to a magnet armature in the two magnetic circuits, capable to powerlessly lock the magnet armature in both stable positions. Swiveling of the magnet armature is essentially determined by the interaction between the flux generated by the excitation windings and the permanent-magnetic fluxes through the soft-magnetic parallel circuits.

According to the aforementioned generic DE 20 2004 012 292, prior art knows a rocking armature of a flat design antifriction mounted at the centre leg to actuate a charge changing valve of an internal combustion engine. A permanent magnet integrated in the centre leg creates a holding force holding the rocking armature in one of the two swivel positions while demanding no flow of current. By alternately energizing both excitation windings at changing polarity the rocking armature alternately swivels by that the respective wing of the rocking armature assigned to the energized excitation winding is attracted due to the addition of the permanent-magnetically created secondary flux over the open armature air gap and the unidirectional, in each case, electromagnetic flux over the open armature air gap. Swiveling over occurs against the holding force of the permanent-magnetically created flux through the dead parallel circuit that has established over the closed armature air gap having locked the rocking armature in its position until then.

Many known magnetic actuators for electromagnetic drive systems with a reversible excitation winding or two separately controllable excitation windings are based on the described principle such as to DE 6751 327 DE 1 938 723 U1, DE 43 14 715 A1, DE 696 03 026 T2, EP 0 197 391 B2. Always the excitation winding in that parallel circuit is energized to the side of which the rocking armature is intended to swivel, with the electromagnetic flux directed equal-sense to the permanent-magnetically created secondary flux. In each case, however, the holding force the permanent-magnetically created flux exerts on the attracted armature wing must be overcome, which requires a significant energetic effort.

Further, from DE 33 23 481 A1, for example, polarized bistable relays with a one-mesh magnetic circuit and a rotatable H-armature pull equipment provided with a permanent magnet are known where the H-armature pull equipment is swivelable into its two switching positions by the magnetic field of an excitation winding To switch the relay the polarity of the magnetic field is reversed by applying a voltage pulse in each case so that the H-armature pull equipment swivels into the respective other switching position. But also here the electromagnetic flux is created on the H-armature pull equipment to be swiveled over.

The objective of this invention is to provide an energy-efficient bistable magnetic actuator having a simple low-weight, low-volume design and a high switching power density that is particularly suitable for bistable relays of high switching capacity.

BRIEF SUMMARY OF THE INVENTION

According to the invention the problem is solved by the features of the claim Advantageous further embodiments are given by the accompanying claims. Particularly, in an advantageous further embodiment it is intended to also create an asymmetric swiveling force based on one and the same magnetic circuit arrangement.

The magnetic actuator according to the invention enables an especially energy-efficient swiveling over of the rocking armature from one swivel position to the other, which is particularly advantageous for magnetic armatures that have to meet strict external general conditions relating to installation space, actuating energy and actuating force. As opposed to known actuators where active reluctance forces, hence swiveling forces are produced by unidirectional, adding up magnetic fluxes caused by the permanent magnet and the excitation winding and created over the open armature air gap of that parallel circuit where the actively accessed excitation winding is located, according to the invention the permanent-magnetic flux is displaced from the parallel circuit closed over the armature wing into the other parallel circuit by an electromagnetic flux opposed to the permanent-magnetic flux. For that a d.c. voltage pulse is applied to the excitation winding placed in the parallel circuit with the closed armature air gap, in such a way that the electromagnetic flux counteracts the permanent-magnetic flux so that the permanent-magnetic flux commutates into the parallel circuit with the open armature air gap. The resulting permanent-magnetic force action composed of the additional proportion of the permanent-magnetic secondary flux over the open armature air gap and the proportion of the commutated permanent-magnetic flux causes the rocking armature to switch over into its other stable switching position.

It should be noted that each of the two parallel magnetic circuits advantageously has a very low magnetic resistance, for the armature air gap closed in each case, because the permanent magnet placed in the centre leg is designed extremely flat based on its high coercivity and high remanence, thus causing a very low magnetic resistance. The U-shaped yoke with its two outer legs is made one-part, which additionally reduces the magnetic resistance compared to known arrangements with a built-up U-shaped yoke. Rolling friction makes the rocking armature bearing work very efficiently on metallic surfaces.

BRIEF DESCRIPTION OF THE DRAWINGS

The invention will be explained in greater detail using an example of embodiment. In the accompanying drawings it is shown by FIGS. 1 to 3 the operational mode of a magnetic actuator according to the invention, FIG. 4 a magnetic actuator in an explosive representation, FIG. 5 the magnetic armature in perspective view, and FIGS. 6 and 7 a version with asymmetric generation of a switching force.

DETAIL DESCRIPTION OF THE INVENTION

Figure 1:
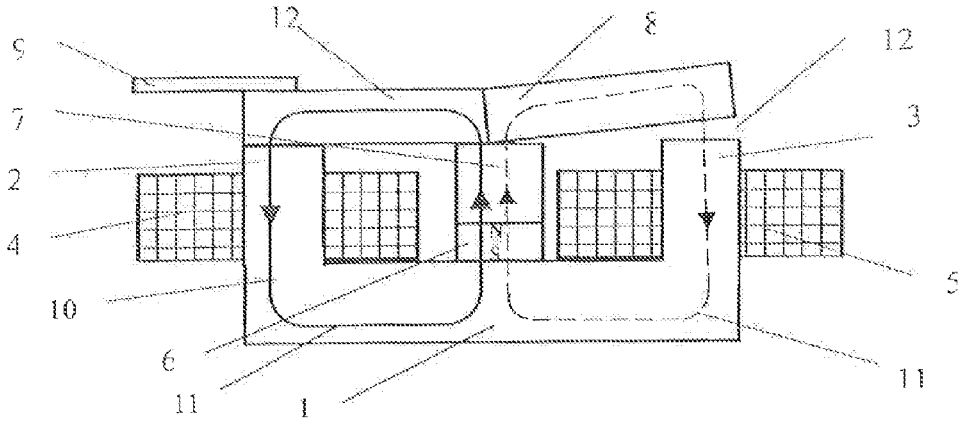
Figure 2:
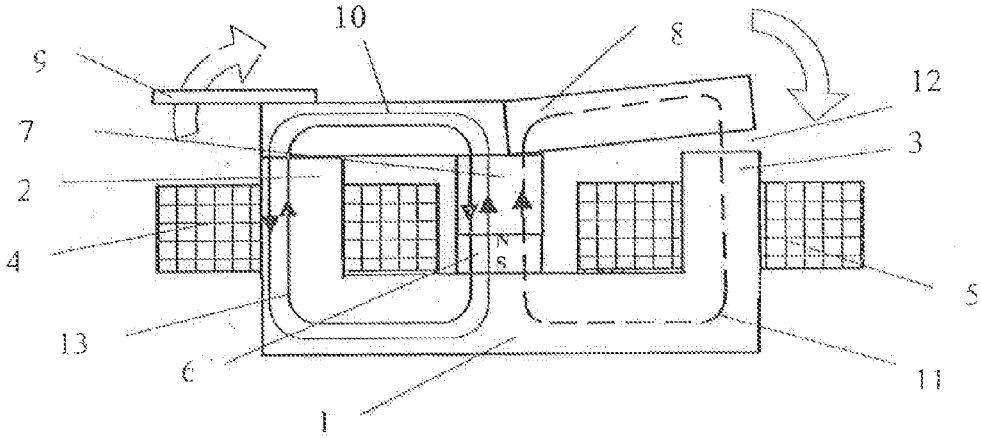
Figure 3:
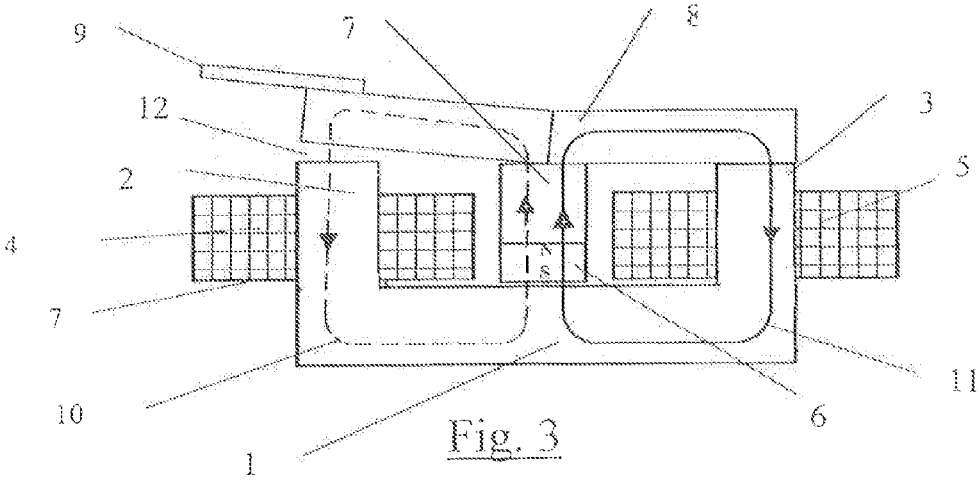

In the FIGS. 1 to 3 the operational mode of a magnetic actuator is schematically shown. The actuator has as a carrying part a U-shaped soft-iron yoke 1 with separately controllable excitation windings 4, 5 placed on the outer legs 2, 3 of the yoke 1. An extremely flat but strong permanent magnet 6 supports a soft-iron centre leg 7. Thus an E-shaped magnet core is formed. A rocking armature 8 slightly bent in V-shape is supported at the centre leg 7. The E-shaped magnet core together with the rocking armature 8 starting from the centre leg 7 is a parallel circuit of the armature air gaps. At one end the rocking armature 8 carries an actuating member 9 for a contact system, for example, of a bipolar relay. In the position of the rocking armature 8 shown in FIGS. 1 and 2 a permanent-magnetic flux 10 forms in the left parallel circuit over the permanent magnet 6, the soft-iron centre leg 7, the left wing of the rocking armature 8, the left soft-iron centre leg 2, the yoke 1 and back to the permanent magnet 6. A permanent-magnetic holding force acts on the left wing of the rocking armature 8. Over the right parallel circuit a permanent-magnetically created secondary flux 11 flows aspiring to reduce the air gap 12 between the right wing of the armature 6 and the left outer leg 3, that is to attract the right wing of the rocking armature 6. This permanent-magnetically created secondary flux 11, however, is weaker than the permanent-magnetically created magnetic flux 11 on the left side of the magnetic actuator, because due to the open air gap 12 towards the rocking armature 8 based on the high magnetic resistance of the air gap 12 a comparably low permanent-magnetically created secondary flux 11 develops.

If now, according to FIG. 2, a power pulse is applied to the left excitation winding 4, an electromagnetic flux 13 is generated over the excitation current in the left parallel circuit for a short time. For an according direction of winding of the excitation winding 4 and polarity of the power pulse the electromagnetic flux 13 is opposed to the permanent-magnetic flux 10 in the left parallel circuit, as indicated by arrows in FIG. 2. The permanent-magnetically created magnetic flux 10 is displaced from the left parallel circuit into the right parallel circuit. The magnetic flux 10 commutates into the right parallel circuit and exerts a magnetic attraction on the right wing of the rocking armature 8 clockwise swiveling the rocking armature 8. In FIG. 3 the second stable position of the rocking armature 8 is shown. The permanent-magnetically created magnetic flux 10 now in the right parallel circuit fixes the rocking armature 8 in the second swivel position. In the left parallel circuit again a permanent-magnetically created secondary flux develops over the open armature air gap 12. Anti-clockwise swiveling over occurs in an equivalent way by impulsive energizing the excitation winding 5.

Figure 4:
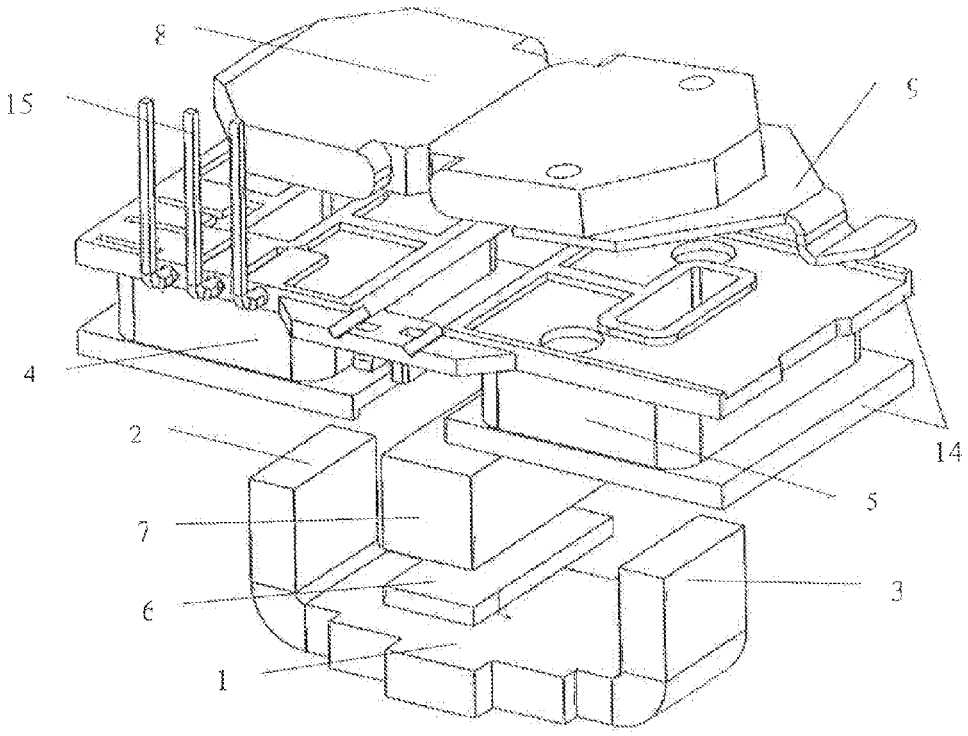

In FIG. 4 a magnetic actuator for a bistable switching relay is shown in an explosive drawing. The U-shaped soft-iron yoke 1 with its both yoke legs 2, 3 is one-part stamped and bent from soft-iron sheet. At the centre part of the yoke a permanent magnet 6 is placed in its turn carrying a soft-iron centre leg 7. The yoke legs 2, 3 are provided with excitation windings 4, 5 carried by an insulator body 14. The excitation windings 4, 5 are appropriately wound in an insulator body 14 folded up over at least one film hinge in one operation with bringing out the inner line ends. The four ends of the excitation windings 4, 5 are soldered to three winding connections 15 with the two inner winding ends commonly led to the central connection. In this way the two excitation windings 4, 5 are separately controllable, passed by the excitation current in opposite directions. The rocking armature 8 is knife-edge mounted to the centre leg 7. Such an armature bearing is very low in friction, only requiring little switching power. The magnetic force of the extremely thin but strong permanent magnet 6 is sufficient to hold all four ferromagnetic components 1, 6, 7 and 8 so that a separate holding is not necessarily needed. Only the rocking armature 8 is laterally guided by the insulator body 14, otherwise held by the force of the permanent magnet 6. At one wing of the rocking armature 8 a resilient actuating member 9 is located that acts on the contact system of a switching relay over a transmission member not shown in detail. Depending on the switching position of the rocking armature 8 the relay opens or doses its primary current circuit. But also other applications for almost any control problem are possible.

The magnetic actuator can be easily miniaturized and, particularly, be designed very flat. Based on the little number of components it is cost-effective and low-weight. Switching over from one switching position into the other only requires little power as described referring to the FIGS. 1 to 3.

Figure 5:
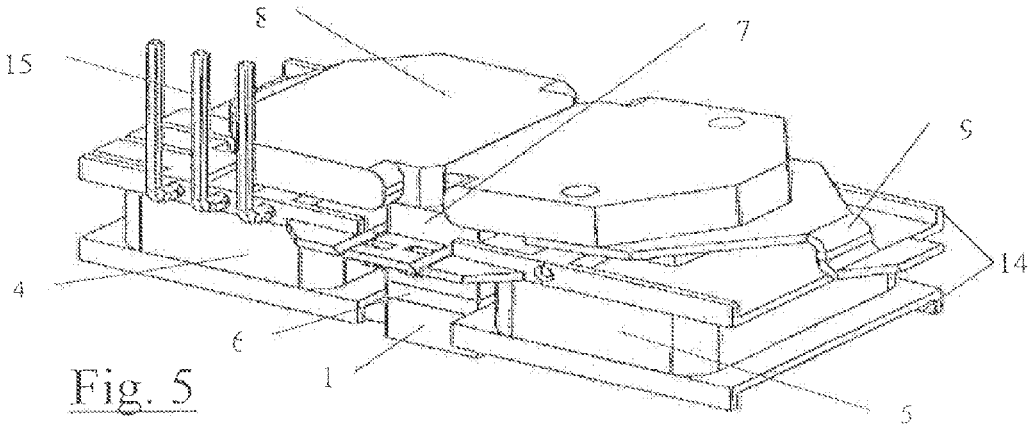

In FIG. 5 the magnetic actuator to FIG. 4 is again shown in a perspective view in assembled condition, with the same references used as in the previous drawings. It should be noted that the actuating member 9 fastened to the rocking armature 8 is established resilient, having two different spring load-deflection characteristics depending on the direction of the acting force. To reach actuation at an initial force>0, advantageously the resilient actuating member 9 is pre-stressed when mounted to the rocking armature 8.

Figure 6:
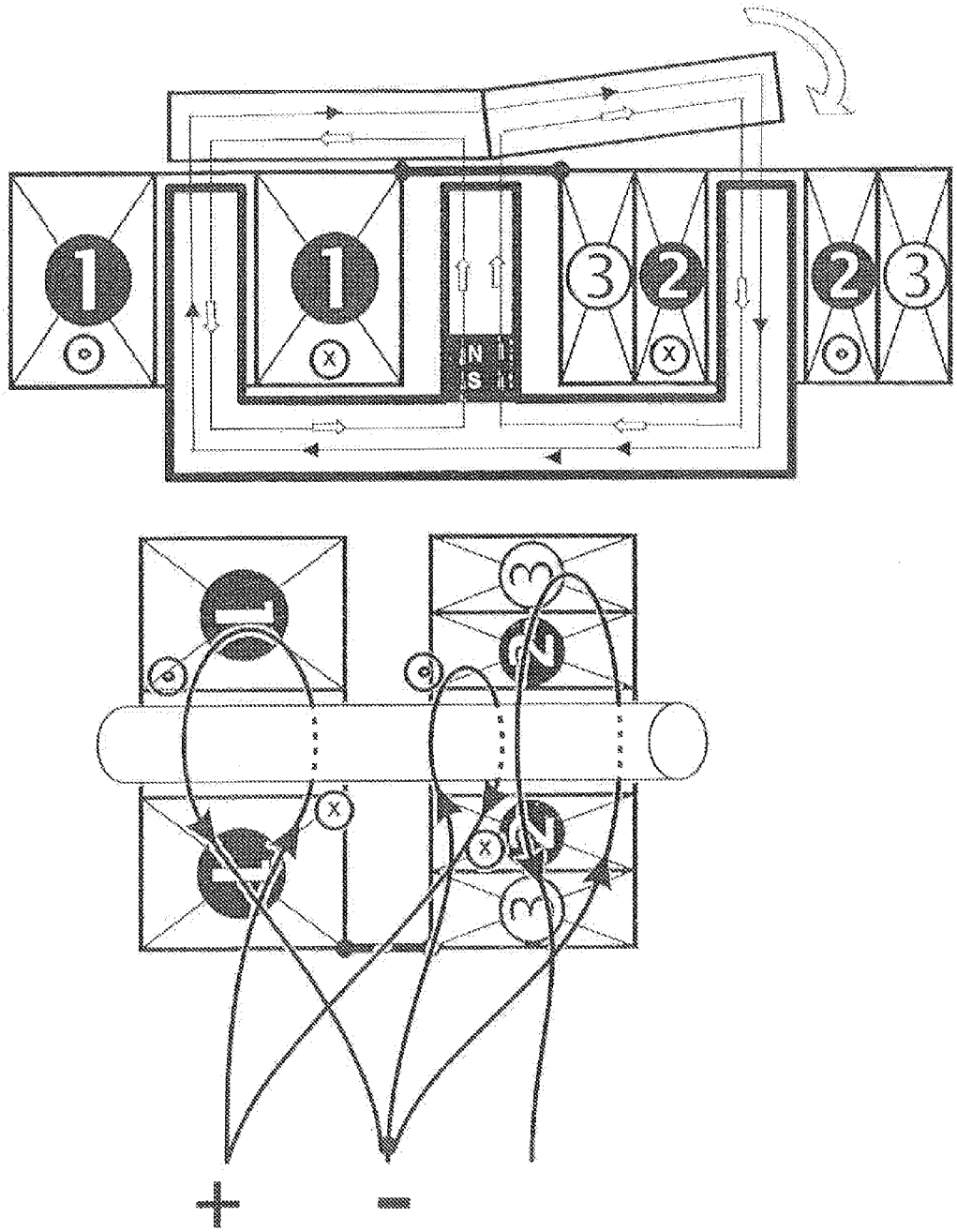
Figure 7:
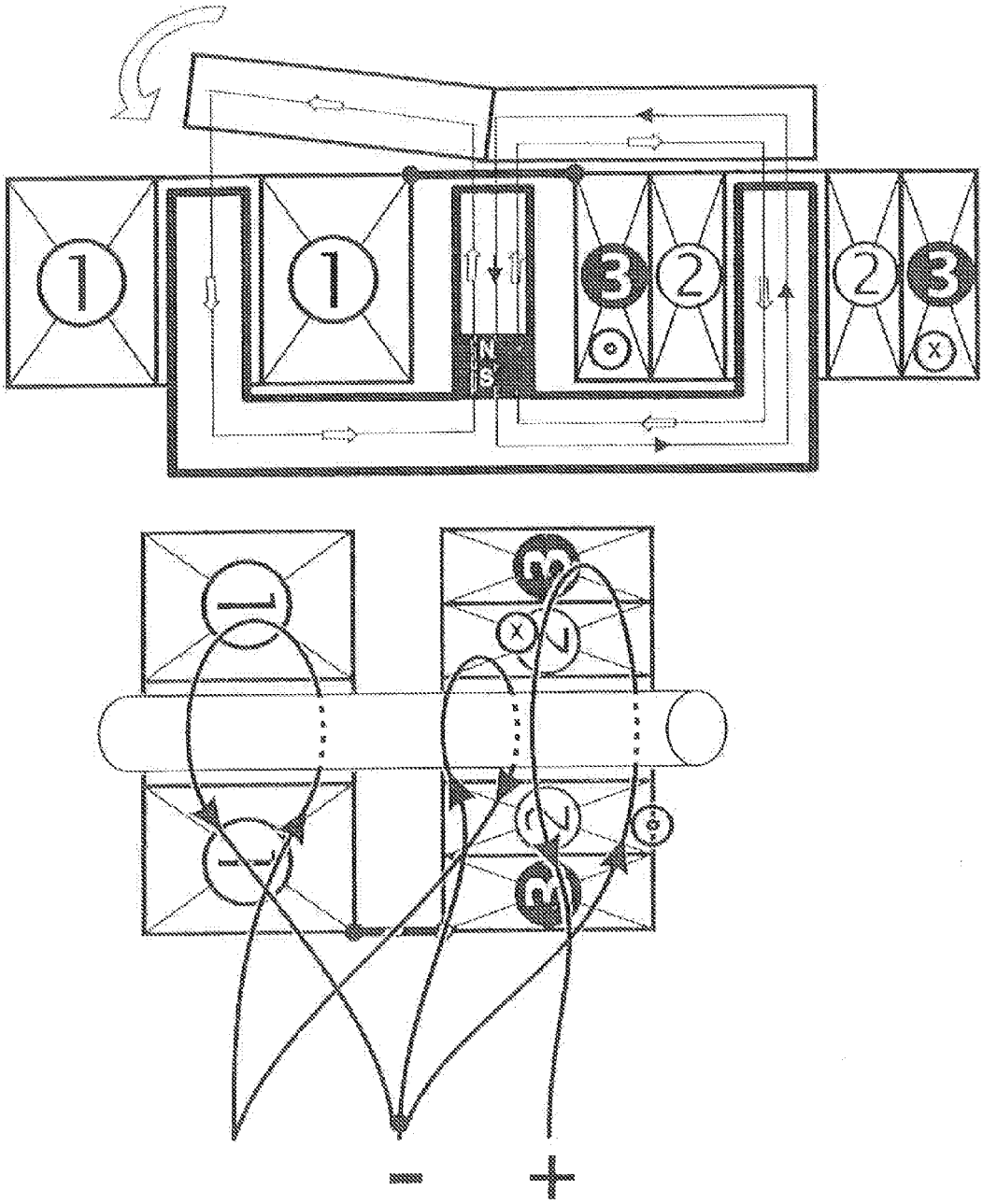

According to another embodiment, to FIGS. 6 and 7, also an asymmetric swiveling force can be produced using one and the same parallel magnetic circuit arrangement. This version makes possible to reach that a swiveling motion of a rocking armature is made at a stronger force in one direction compared with a swiveling motion in the other direction. This can be useful, for example, for relays of high switching capacity when welding of an actuated relay contact is to be released, or when increased pre-stress is to be applied to a relay contact. According to the invention this is achieved using an asymmetric arrangement of the excitation windings while keeping the symmetry of the mechanical arrangement of the magnetic actuator.

According to FIG. 6, the rocking armature is to be attracted by the right-side parallel circuit of a magnetic core, then swiveling over. This is the problem of which it is assumed that the rocking armature should create a stronger force for swiveling than to the other side. Both the permanent-magnetically created magnetic flux and the permanent-magnetically created secondary flux are symbolized by full-black arrows. The fluxes correspond to the permanent-magnetic fluxes drawn in FIG. 2, which means that the permanent-magnetically created magnetic flux in the left parallel circuit due to the closed magnetic circuit is stronger than the permanent-magnetically created secondary flux in the right parallel circuit where the armature air gap is to be overcome. A d. c. voltage pulse is applied to the excitation windings 1 and 2 for swiveling over the rocking armature. The bottom part of FIG. 6 symbolizes the necessary wiring of the excitation windings 1 and 2, the direction of their windings and the polarity of the d. c. voltage pulse. The d. c. voltage pulse produces an electromagnetic flux in the magnetic actuator, symbolized by the edged small arrows, the electromagnetic flux closing over both parallel circuits, is in the right outer leg unidirectional to the permanent-magnetically created secondary flux and in the left outer leg opposed to the permanent-magnetically created magnetic flux. In addition to displacing the permanent-magnetically created magnetic flux from the left parallel circuit, as has already been explained referring to FIGS. 1 to 3, now contrary to the symmetric winding, the electromagnetically created flux from coil 2 supports the permanent-magnetically created secondary flux through its field lines unidirectional to the permanent-magnetically created secondary flux so that a significantly increased switching force develops. The rocking armature swivels clockwise with a stronger force than for symmetrically arranged windings. Because not passed by the coil flux, the permanent magnet cannot be demagnetized.

Swiveling over into the other swivel position is now explained referring to FIG. 7, that means the left magnetic circuit attracts the rocking armature. The permanent-magnetic fluxes correspond to those of FIG. 3. For switching over the rocking armature a d. c. voltage pulse is applied to the excitation windings 3. FIG. 7, again the bottom part, symbolizes the wiring of the excitation windings 3, the direction of the windings and the polarity of the d. c. voltage pulse. The d. c. voltage pulse produces an electromagnetic flux, symbolized by the edged small arrows, in the right parallel circuit closing over the centre leg, opposing the permanent-magnetically created magnetic flux in the right parallel circuit. The permanent-magnetically created magnetic flux is displaced from the right outer leg into the left outer leg, there adding to the permanent-magnetically created secondary flux. The rocking armature swivels over anti-clockwise so that now a permanent-magnetically created secondary flux over the right parallel circuit develops and a permanent-magnetically created magnetic flux over the left parallel circuit powerlessly holds the rocking armature in another stable position. If the start of this motion is supported by an external force, such as a spring, the coil 3 can be designed having only a few windings.

Also for a winding configuration with an additional winding, as is shown by drawing, only three winding connections are needed, with a d. c. control voltage pulse applied to only two poles in each case. At the same time, this winding configuration can be realized, as shown in FIGS. 6 and 7, by a winding process starting from the central winding connection over the left to the right winding connection.

NOMENCLATURE

1 U-shaped soft-iron yoke
2 left yoke leg
3 right yoke leg
4 left excitation winding
5 right excitation winding
6 permanent magnet
7 soft-iron centre leg
8 rocking armature
9 actuating member
10 permanent-magnetically created magnetic flux through a parallel circuit
11 permanent-magnetically created secondary flux through a parallel circuit
12 armature air gap
13 electromagnetic flux through the magnetic circuit
14 insulator body for the excitation windings
15 winding connections for the excitation windings

The invention claimed is:

1. A bistable magnetic actuator comprising
a polarized magnetic circuit and parallel operating air gaps,
a U-shaped soft . . . iron yoke having outer legs,
wherein between the outer legs of the U-shaped soft-iron yoke a permanent magnet is integrated which carries a soft-iron centre leg and applies a permanent-magnetic flux to a rocking armature supported on the centre leg,
wherein at each outer leg a separately controllable excitation winding provides swiveling pulses for the rocking armature to swivel from one permanent-magnetically self-holding swivel position into the other, and having a wiring such that the permanent-magnetically created magnetic flux through the magnetic circuit is closed over the rocking armature in each case, for an electromagnetic magnetic flux created by the excitation winding of the magnetic circuit in a direction opposed to the permanent-magnetically created magnetic flux commutates into the parallel arranged magnetic circuit branch with the electromagnetically not excited excitation winding, swiveling over the rocking armature supported by the permanent-magnetically created secondary flux in this parallel circuit.

2. The bistable magnetic actuator to claim 1, wherein an additional excitation winding is established on one of the outer legs which is switched and wound such that it is excited simultaneously with the excitation winding on the other outer leg, creates a supporting electromagnetic flux in the same direction as the permanent-magnetically created magnetic flux for swiveling over the rocking armature into this magnetic circuit, obtaining force amplification in this direction.

3. The bistable magnetic actuator to claim 1, wherein the bistable magnetic actuator is combined with switching relays.

4. The bistable magnetic actuator according to claim 1, wherein the winding connections for the excitation windings are arbitrarily shaped, exiting from the housing at any point.

5. The bistable magnetic actuator according to claim 1, wherein the excitation windings are located on a two-part insulator body that is connected over at least one film hinge, and are wound in one operation.

6. The bistable magnetic actuator according to claim 1, wherein an actuating member mounted to the rocking armature is resilient, having two different spring load-deflection characteristics depending on the direction of the acting force.

7. The bistable magnetic actuator according to claim 6, wherein the resilient actuating member (9) is pre-stressed when mounted to the rocking armature (8).

* * * * *